US005758222A

United States Patent [19]

Tanaka

[11] Patent Number: 5,758,222

[45] Date of Patent: May 26, 1998

[54] APPARATUS FOR AND METHOD OF DEVELOPMENT PROCESSING

[75] Inventor: Tadashi Tanaka, Kanagawa, Japan

[73] Assignee: Fuji Photo Film Co., Ltd., Kanagawa, Japan

[21] Appl. No.: 845,040

[22] Filed: Apr. 21, 1997

[30] Foreign Application Priority Data

Apr. 26, 1996 [JP] Japan ..... 8-108174

[51] Int. Cl.[6] ..... G03D 7/00

[52] U.S. Cl. ..... 396/571; 34/31

[58] Field of Search ..... 396/571, 572, 396/579; 34/446, 447, 444, 329, 369, 463, 589; 430/432

[56] References Cited

U.S. PATENT DOCUMENTS 4,914,835 4/1990 Kose et al. ..... 396/571

FOREIGN PATENT DOCUMENTS 7-295193 11/1995 Japan ..... G03D 15/02

*Primary Examiner*—D. Rutledge

*Attorney, Agent, or Firm*—Sughrue, Mion, Zinn, Macpeak & Seas, PLLC

[57] ABSTRACT

A development processing apparatus in which a photosensitive material is processed in processing solutions, and thereafter, the photosensitive material which has been processed in the processing solutions is subjected to drying processing by a dry air from a drying machine built in the development processing apparatus, comprising: a re-drying section which delivers the dry air from the drying machine to the outer side of the development processing apparatus; and photosensitive material holding means in which, in order to dry again the photosensitive material which has been subjected to drying processing by the dry air from the re-drying section, the photosensitive material which has been subjected to drying processing is held such that the surface of the photosensitive material which has been subjected to drying processing is substantially parallel to the direction of the dry air delivered from the re-drying section. Therefore, even if the plurality of photosensitive materials which have been subjected to drying processing are held by the photosensitive material holding means, each surface of the photosensitive materials which have been subjected to drying processing is substantially parallel to the dry air from the re-drying section, and the dry air flows between the photosensitive materials adjacent to each other. Accordingly, the photosensitive materials which have been subjected to drying processing are reliably dried again.

10 Claims, 7 Drawing Sheets

APPARATUS FOR AND METHOD OF DEVELOPMENT PROCESSING

BACKGROUND OF THE INVENTION

1. Field of the Invention

The present invention relates to an apparatus for and a method of development processing in which the end portion of a photographic film such as a negative film is reliably dried, and can be applied to a photographic processing system or the like.

2. Description of the Related Art

A negative film, onto which images are recorded by a camera, is sent to a processing laboratory in a state in which the negative film is accommodated within a cartridge. Thereafter, the negative film is developed in a film developing apparatus.

At the time of development processing, a method of developing has been generally used in which a leader for conveyance is connected by an adhesive tape to the end portion of a negative film withdrawn from a cartridge, and then the negative film is conveyed and developed in the film developing apparatus.

After such leader conveying method is used and development processing is effected in the film developing apparatus, the periphery of the portion of the film connected to the leader for conveyance is cut so that the connected leader for conveyance is removed from the film. Thereafter, images recorded onto the film are printed by a printer which is an apparatus for printing images on a photographic printing paper.

However, in a negative film in which cutting of the distal end portion of the film is not allowed, only after the adhesive tape is stripped from the film, it is necessary to carry out a printing operation as the next processing. At this time, solution permeates the portion of the negative film to which the adhesive tape has been connected and the portion is not completely dried. Accordingly, a drawback may arise in that poor conveyance is effected in the printing operation.

Consequently, it has been considered that the film and the leader for conveyance are connected by inserting engaging pieces provided at the leader for conveyance through the engaging holes of the film and by engaging the engaging pieces with the edge portions of the engaging holes, in a state in which the developed film is stored in a leader stock section, the connecting portion is dried again by using dry hot air from the film developing apparatus JP-A No. 7-295193.

However, according to this method, since drying is effected in a state in which the film and the leader for conveyance are connected, drying efficiency is poor, and it is difficult to dry sufficiently the portion of the film connected to the leader for conveyance. Further, because the dry hot air is blown perpendicular to the surface of the film connected to the leader for conveyance, it is difficult to dry the connecting surface.

SUMMARY OF THE INVENTION

With the aforementioned in view, an object of the present invention is to provide a method of and an apparatus for development processing in which inconvenience in a subsequent processing due to insufficient drying of a film can be prevented.

A first aspect of the present invention is a development processing apparatus in which a photosensitive material is processed in processing solutions, and thereafter, the photosensitive material which has been processed in the processing solutions is subjected to drying processing by a dry air from a drying machine built in the development processing apparatus, comprising: a re-drying section which delivers the dry air from the drying machine to the outer side of the development processing apparatus; and photosensitive material holding means in which, in order to dry again the photosensitive material which has been subjected to drying processing by the dry air from the re-drying section, the photosensitive material which has been subjected to drying processing is held such that the surface of the photosensitive material which has been subjected to drying processing is substantially parallel to the direction of the dry air delivered from the re-drying section.

The operation of the development processing apparatus relating to the above-described first aspect will be explained hereinafter.

The developed photosensitive material is dried in the development processing apparatus by the dry air from the drying machine built in the development processing apparatus. The development processing apparatus includes a re-drying section which delivers the dry air from the drying machine to the outer side of the development processing apparatus. Further, the development processing apparatus includes the photosensitive material holding means which holds the photosensitive material so that the surface of the photosensitive material which has been subjected to drying processing is substantially parallel to the direction of the dry air delivered from the re-drying section. Accordingly, the photosensitive material which has been subjected to drying processing is held by the photosensitive material holding means and dried again by the dry air from the re-drying section. Moreover, even if the plurality of photosensitive materials which have been subjected to drying processing are held by the photosensitive material holding means, each surface of the photosensitive materials which have been subjected to drying processing is substantially parallel to the direction of the dry air from the re-drying section, and the dry air flows between the photosensitive materials adjacent to each other. Thus, the photosensitive materials which have been subjected to drying processing are reliably dried again.

Further, because the dry air from the drying machine is recycled and the photosensitive material is held so that the surface of the photosensitive material is parallel to the direction of the dry air, even if the drying machine is not provided separately, the photosensitive material can be sufficiently dried.

A second aspect of the present invention is a development processing apparatus according to the first aspect, wherein the photosensitive material is a photographic film, and the positions of the re-drying section and the photosensitive material holding means are set so that the dry air from the re-drying section is delivered to the portion of the photographic film which includes at least a surface connected to a leader by a connecting tape for effecting the processing and the drying processing.

The operation of the development processing apparatus relating to the second aspect will be explained.

The operation of the second aspect is the same as that of the first aspect. In the second aspect, the photosensitive material is a photographic film, and the portion of the photographic film, which includes the surface connected to the leader by the connecting tape for processing and drying processing, is dried again. Accordingly, since the photographic film is dried in a state in which the leader for conveyance and the photographic film are not connected, the photographic film can be completely dried.

In this way, as the portion of the photographic film to which the leader for conveyance has been connected and in which drying tends to be insufficient is dried again, the portion of the photographic film to which the leader for conveyance has been connected by an adhesive tape which is the connecting tape can be sufficiently dried, and inconvenience in a subsequent processing due to the insufficient drying of the film can be prevented.

A third aspect of the present invention is a development processing apparatus according to the first aspect, wherein holes are formed at the photosensitive material, and the photosensitive material holding means includes a holder and a holder mounting portion, and the holder includes pins which are inserted through the holes by moving the photosensitive material so as to hold the photosensitive material, and the holder mounting portion removably supports the holder.

The operation of the above-described third aspect will be described hereinafter.

The operation of the third aspect is the same as those of the first and the second aspects. In the third aspect, holes are formed at the photosensitive material. Further, the photosensitive material holding means includes the holder, which is provided with pins inserted through the holes by moving the photosensitive material, and the holder mounting portion which removably supports the holder.

Because the photosensitive material is supported by the holder in the form of inserting the pins through the holes due to the simple movement of the photosensitive material, the dry air from the re-drying section can be blown substantially parallel to the surface of the portion of the photosensitive material to which the leader for conveyance has been connected. Accordingly, the portion of the photosensitive material to which the leader for conveyance has been connected is dried well.

Further, in the third aspect, the holder is removable from the holder mounting portion so that the photosensitive material together with the holder can be handled in the next processing in a state in which the photosensitive material is held by the holder.

A fourth aspect of the present invention is a method of development processing, comprising the steps of: (a) removing a leader from a photographic film which has been attached to the leader and has been subjected to development processing by processing solutions and drying processing by a drying machine within a development processing apparatus; (b) moving the photographic film from which the leader has been removed so that pins are inserted through holes formed in the vicinity of a portion to which the leader has been attached and engaging the photographic film from which the leader has been removed with the pins; and (c) delivering dry air from the drying machine to the outer side of the development processing apparatus in the direction substantially parallel to the surface of the photographic film which has been engaged with the pins, blowing the dry air to the photographic film which has been engaged with the pins and re-drying the photographic film which has been engaged with the pins.

The operation of the method of development processing relating to the above-described fourth aspect will be explained.

Firstly, the leader connected for developing and drying the photographic film within the development processing apparatus is removed from the photographic film which has been subjected to drying processing. Next, the photographic film is engaged with the pins via the holes which were previously formed in the vicinity of the portion of the photographic film to which the leader has been connected. The photographic film is dried again by the dry air which has been delivered to the outer side of the development processing apparatus so that the dry air is substantially parallel to the surface of the photographic film engaged with the pins.

Accordingly, because the photographic film can be dried again in the same way as the above-described first through third aspects, inconvenience in a subsequent processing due to the insufficient drying of the photographic film can be prevented.

DESCRIPTION OF THE PREFERRED EMBODIMENTS

Figure 1:
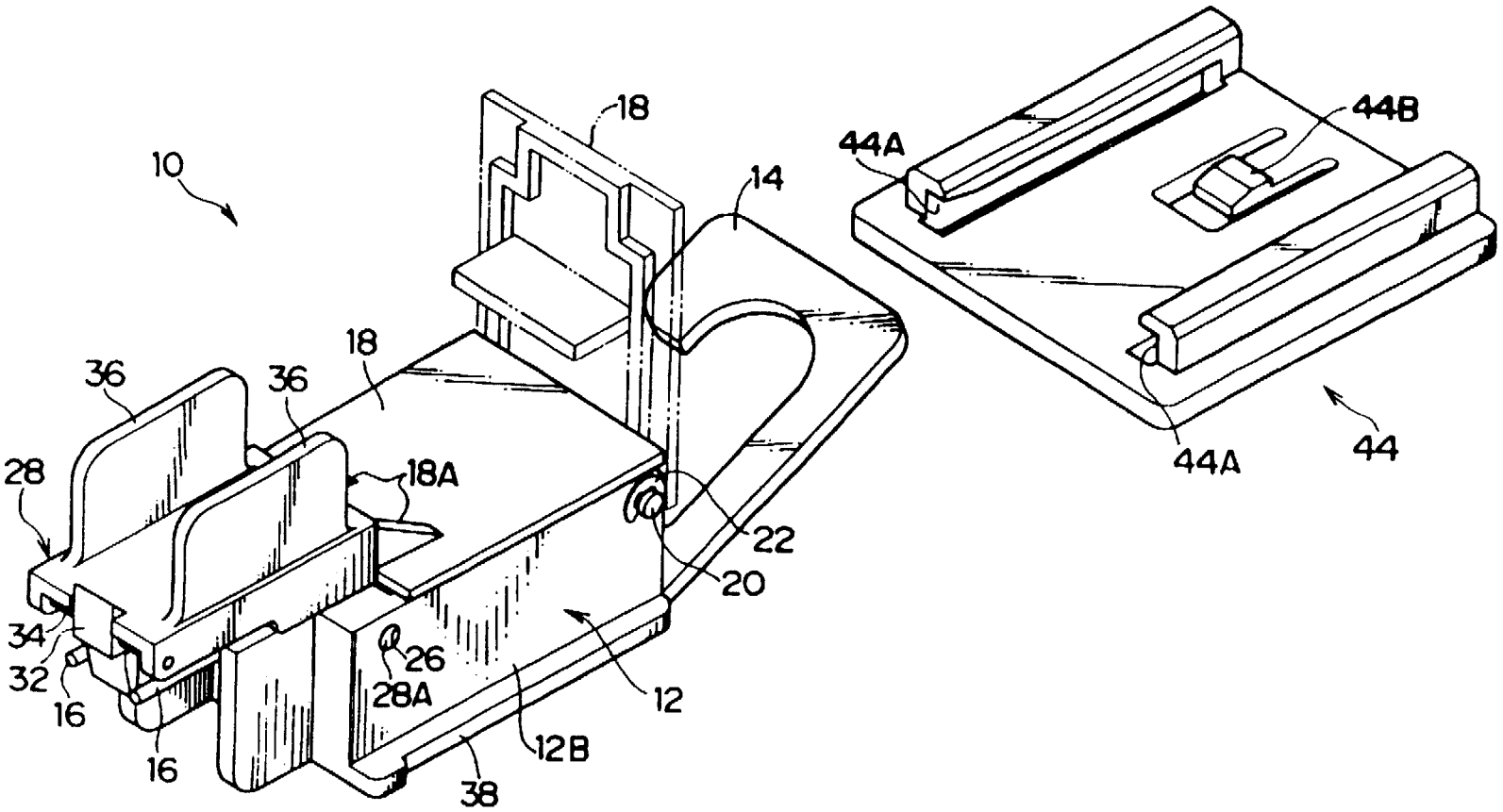
FIG. 1 is a perspective view of a film holder and a mounting stand relating to an embodiment of the present invention.

An apparatus for and a method of development processing relating to an embodiment of the present invention will be explained on the basis of FIGS. 1 through 7.

As illustrated in FIGS. 1 through 4, a film holder 10 includes a substantially rectangular box shaped main body member 12 whose opening portion 12A is disposed at the upper side. The main body member 12 is formed by a material such as a synthetic resin or the like. At the main body member 12, a hook-shaped hook portion 14, which extends outwardly and diagonally upward from one of the side walls of the main body member 12, is formed. The hook portion 14 is used for suspending the film holder 10.

Further, a pair of engaging pins 16, which are parallel to each other and extend outwardly, are provided at a side wall opposing the above-described side wall. The interval between the pair of engaging pins 16 is set the same as the interval between a pair of spool set holes 52 (see FIG. 7), which are formed at the distal end portion of a negative film 50 serving as a photosensitive material for connecting a spool shaft of the film cartridge.

Moreover, the film holder 10 includes a substantially rectangular plate shaped fixed lid (rotatable member) 18 which can cover the opening portion 12A of the main body member 12. A pair of projections including axially-supporting holes are provided at one surface of one end portion of the fixed lid 18 in the longitudinal direction thereof. Further, a pair of substantially triangular ribs 18A are provided at the other surface of the other end portion of the fixed lid 18 in the longitudinal direction thereof. The fixed lid 18 is rotatably supported by a supporting shaft 20, which is suspended between a pair of side walls 12B opposing to each other, via the aforementioned axially-supporting holes. E-rings 22 are engaged with the ends of the supporting shaft 20 so as to prevent withdrawal of the supporting shaft 20 from the pair of side walls 12B.

Figure 2:
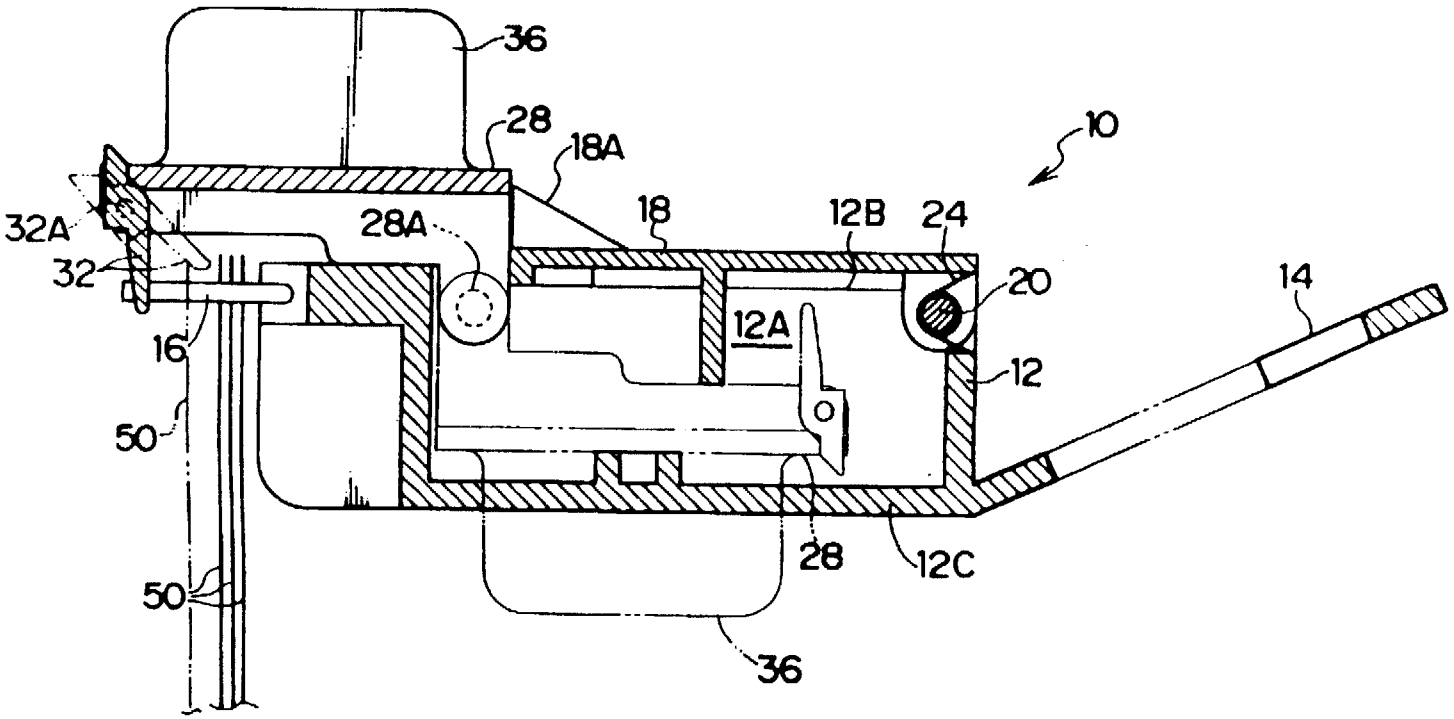
FIG. 2 is a cross-sectional view of the film holder relating to the embodiment of the present invention.

A torsion spring 24, whose end portions are fixed to the fixed lid 18 and the side walls 12B of the main body member 12, is trained around the supporting shaft 20. In FIG. 2, the torsion spring 24 urges the fixed lid 18 in the direction of rotating in a counterclockwise direction. As a result, due to the urging force of the torsion spring 24, the fixed lid 18 can cover and close the opening portion 12A of the main body member 12.

On the other hand, an aperture portion 26 is formed at the portion near the respective other end sides of the side walls 12B. A pair of shaft portions 28A, which protrude from the transverse direction both ends near the longitudinal direction one end portion of a substantially rectangular plate shaped bracket (rotatable member) 28 in the direction of separating from each other, are rotatably inserted through the aperture portions 26. The bracket 28 is rotatably supported by the side walls 12B. The bracket 28 is formed by a material such as a synthetic resin or the like. In a state in which the fixed lid 18 covers the opening portion 12A of the main body member 12, the ribs 18A which are formed at the distal end portions of the fixed lid 18 press the peripheral portions of the shaft portions 28A of the bracket 28. Thus, the position of the bracket 28 illustrated in FIGS. 1 and 2 are maintained.

A withdrawal preventing pawl 32 for preventing withdrawal of the negative film 50 from the engaging pins 16 is provided at the other end portion of the bracket 28. The withdrawal preventing pawl 32 includes a pair of shaft portions 32A which extend in the direction of separating from each other. The shaft portions 32A are rotatably inserted through the holes formed at the other end portions of the bracket 28, and the withdrawal preventing pawl 32 is rotatably supported around the shaft portions 32A by the bracket 28.

Moreover, the torsion spring 34, whose end portions are fixed to the withdrawal preventing pawl 32 and the bracket 28, is trained around the shaft portions 32A of the withdrawal preventing pawl 32. In FIG. 2, the torsion spring 34 urges the withdrawal preventing pawl 32 in the clockwise rotating direction from the proximal end portion of the engaging pin 16 to the distal end portion thereof. In the urged state, one end portion of the withdrawal preventing pawl 32 abuts the bracket 28, and the other end portion of the withdrawal preventing pawl 32 is positioned near the distal end portions of the pair of engaging pins 16 and between the pair of engaging pins 16.

The withdrawal preventing pawl 32 uses a one-way inclining system in which the withdrawal preventing pawl 32 inclines in one direction only Namely, in FIG. 2, the withdrawal preventing pawl 32 is rotated in the counterclockwise direction from the position shown by a solid line to the position shown by a chain double-dashed line. Therefore, the negative film 50 can be pressed into the proximal end portion sides of the engaging pins 16 which resist the urging force of the torsion spring 34.

As a result, when the engaging pins 16 are inserted through the spool set holes 52 of the negative film 50 by bringing the distal end portion of the negative film 50 closer to the engaging pins 16, and then the negative film 50 is pressed in the direction of the proximal end portion of the engaging pin 16, as illustrated in the chain double-dashed line in FIG. 2, the withdrawal preventing pawl 32 is rotated around the shaft portions 32A against the urging force of the torsion spring 34. When the negative film 50 is further pressed, the distal end of the withdrawal preventing pawl 32 is finally removed from the negative film 50. Due to the urging force of the torsion spring 34, the withdrawal preventing pawl 32 returns to its original position shown by the solid line in FIG. 2. At the same time, the negative film 50 is not easily removed from the engaging pins 16 due to the prevention by the withdrawal preventing pawl 32.

Figure 3:
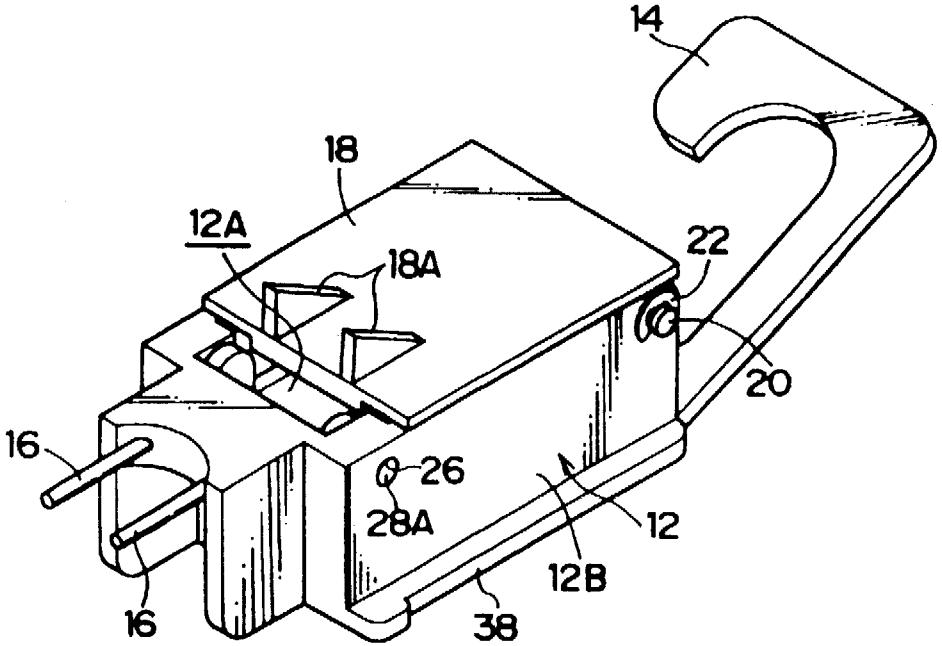
FIG. 3 is a perspective view of the film holder relating to the embodiment of the present invention in a state in which a bracket is accommodated therewithin.

On the other hand, as illustrated by a chain double-dashed line in FIG. 1, when the fixed lid 18 is opened and the bracket 28 is rotated around the shaft portion 28A, the bracket 28 is accommodated within the main body member 12. In the accommodated state, the fixed lid 18 is rotated so as to close the opening portion 12 of the main body member 12. The state shown in FIG. 3 is thereby formed.

A pair of convex walls 36 are formed at the back side of the bracket 28. In a state in which the bracket 28 is accommodated within the main body member 12, the pair of convex walls 36 protrude through a pair of elongated openings formed at the bottom wall 12C of the main body member 12.

Figure 4:
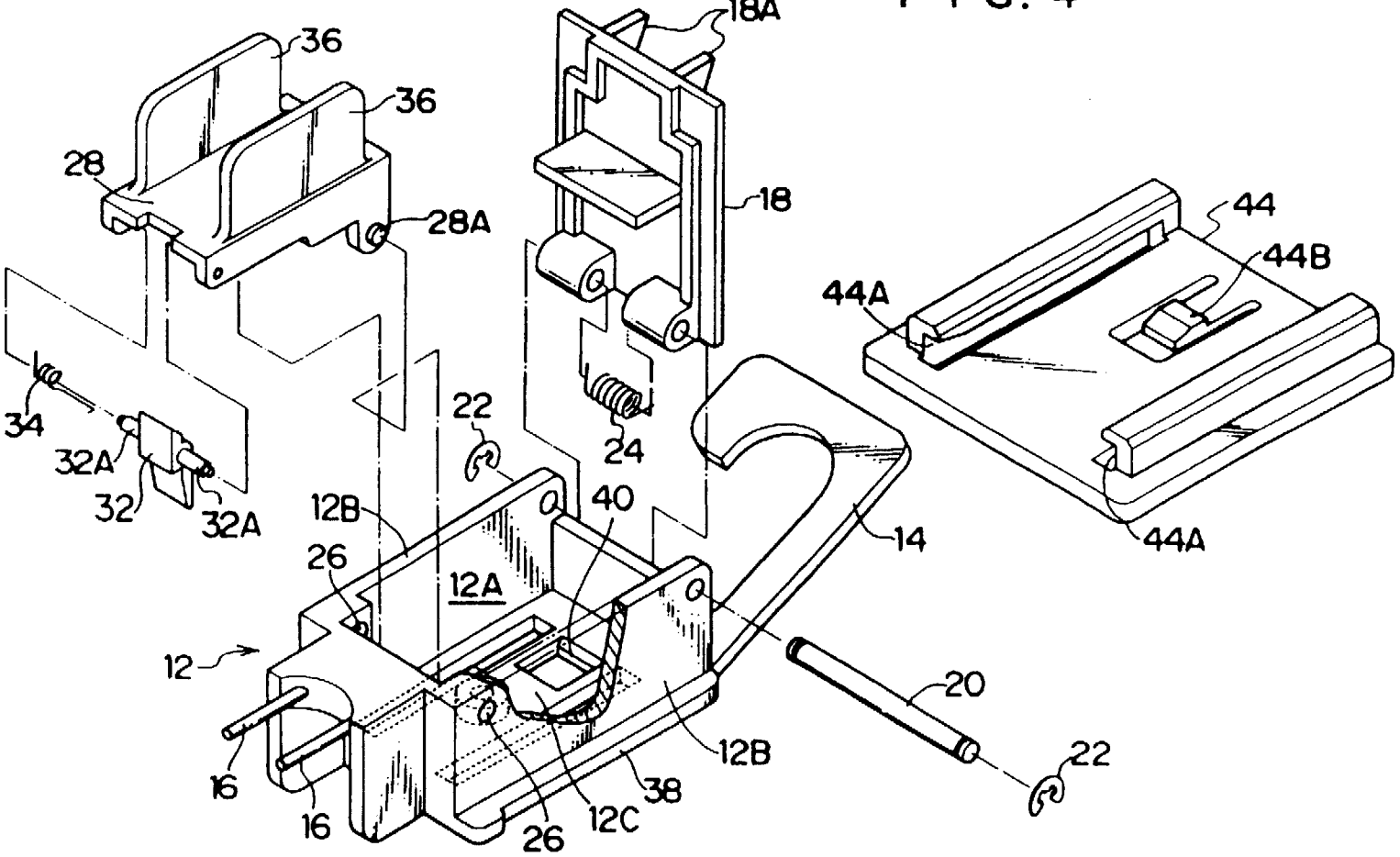
FIG. 4 is an exploded perspective view of the film holder relating to the embodiment of the present invention.

Further, as illustrated in FIGS. 1 and 4, a pair of guide pieces 38 protrude in a flange shape from the bottom wall 12C of the main body member 12, and a rectangular opening 40 is formed at the bottom wall 12C. On the other hand, a mounting stand 44 which forms a mounting portion of the holder 10 is provided. The mounting stand 44 is substantially rectangular plate shaped, and a pair of rail-like projections are provided at one surface of the mounting stand 44 so as to correspond to the pair of guide pieces 38. Grooves 44A are formed on the opposing surfaces of the projections along the longitudinal directions thereof. Moreover, the mounting stand 44 includes a cantilever-type lock portion 44B so as to correspond to the aforementioned opening 40. Accordingly, when the bottom wall 12C of the main body member 12 is slid on the mounting stand 44 so that the respective guide pieces 38 are inserted through the respective grooves 44A and the main body member 12 and the mounting stand 44 are placed at predetermined positions, the lock portion 44B resiliently enters the opening 40. In this way, the holder 10 and the mounting stand 44 are engaged.

As described hereinbefore, a photosensitive material holding apparatus is formed by the film holder 10 and the mounting stand 44.

Next, a processing apparatus main body 60 relating to the present embodiment will be explained.

Figure 5:
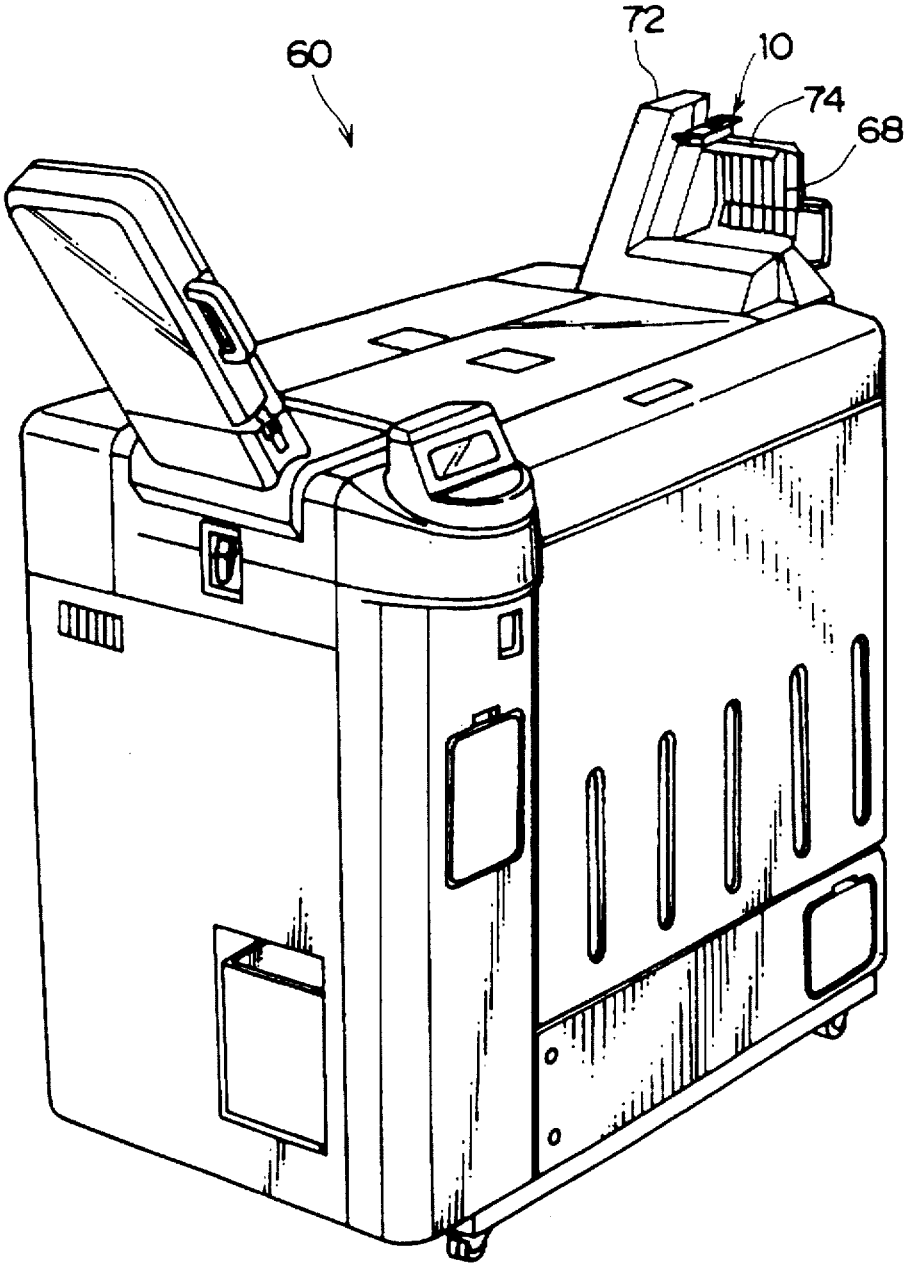
FIG. 5 is a perspective view of a processing apparatus main body relating to the embodiment of the present invention.
Figure 6:
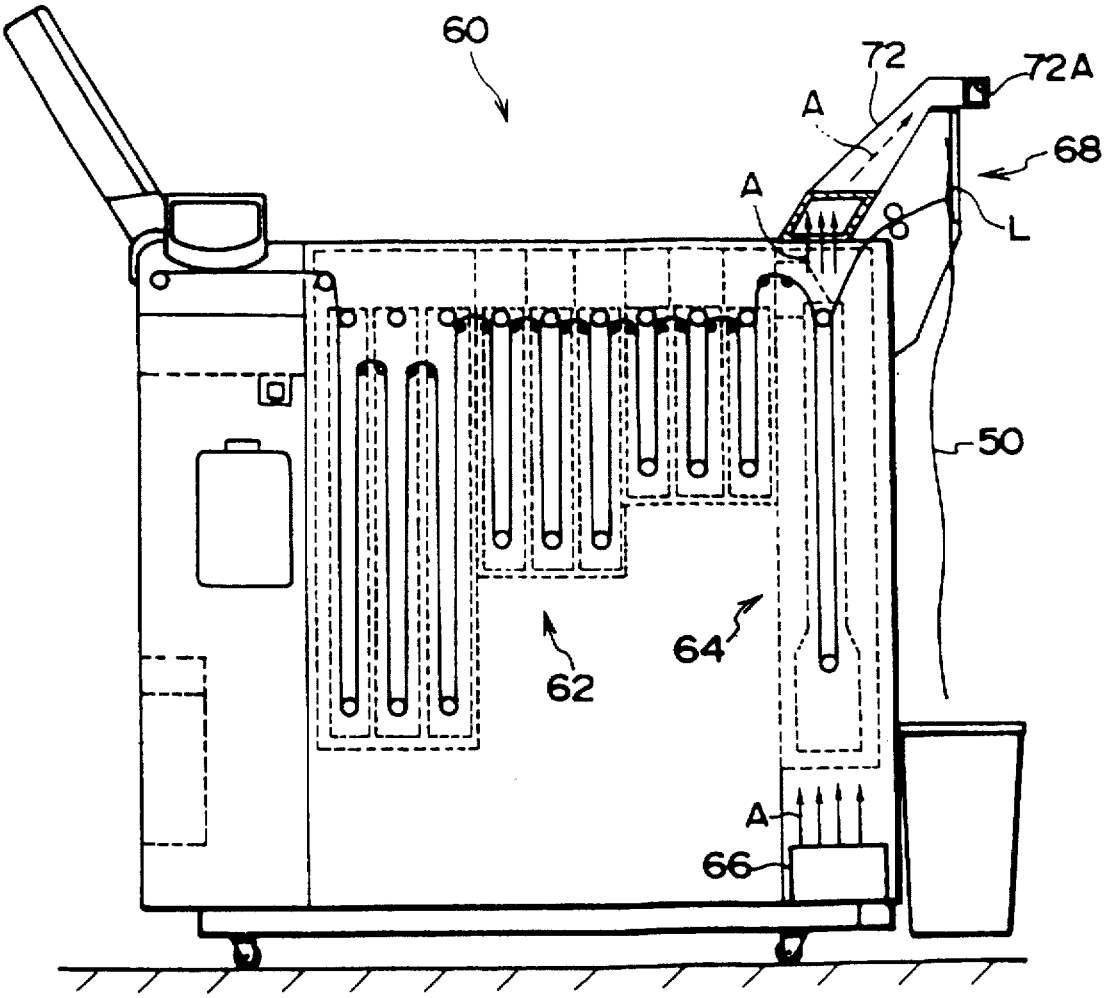
FIG. 6 is a side view of the processing apparatus main body relating to the embodiment of the present invention.

As illustrated in FIGS. 5 and 6, the processing apparatus main body 60 includes a processing section 62 formed by tanks such as a developing tank, a fixing tank and a washing tank for developing the negative film 50. The negative film 50 connected to a leader L for conveyance by an adhesive tape (unillustrated) is conveyed, is successively submerged into the processing solutions within the tanks, and thereafter, is subject to development processing.

In FIG. 6, a drying section 64, in which a drying machine 66 such as a blower or the like is built at the bottom thereof, is disposed at the upper and right-hand side portion of the processing apparatus main body 60. As a result, when the developed negative film 50 is conveyed to the drying section 64, the negative film 50 is dried by the dry hot air which is blown from the drying machine 66 and shown by arrow A.

Thereafter, the negative film 50 is conveyed to a discharge section 68 provided at the right end of the processing apparatus main body 60 and is stocked in the discharge section 68 in a state in which the negative film 50 is connected to the leader L for conveyance.

On the other hand, in FIG. 6, a duct 72, which extends in a pipe shape toward the upper right side, is disposed above the drying section 64. After the negative film 50 is dried by the dry hot air blown from the drying machine 66, the air enters the duct 72. The dry hot air serving as discharged hot air collected by the duct 72 is conveyed out of a nozzle opening 72A formed at the distal end portion of the duct 72.

Figure 7:
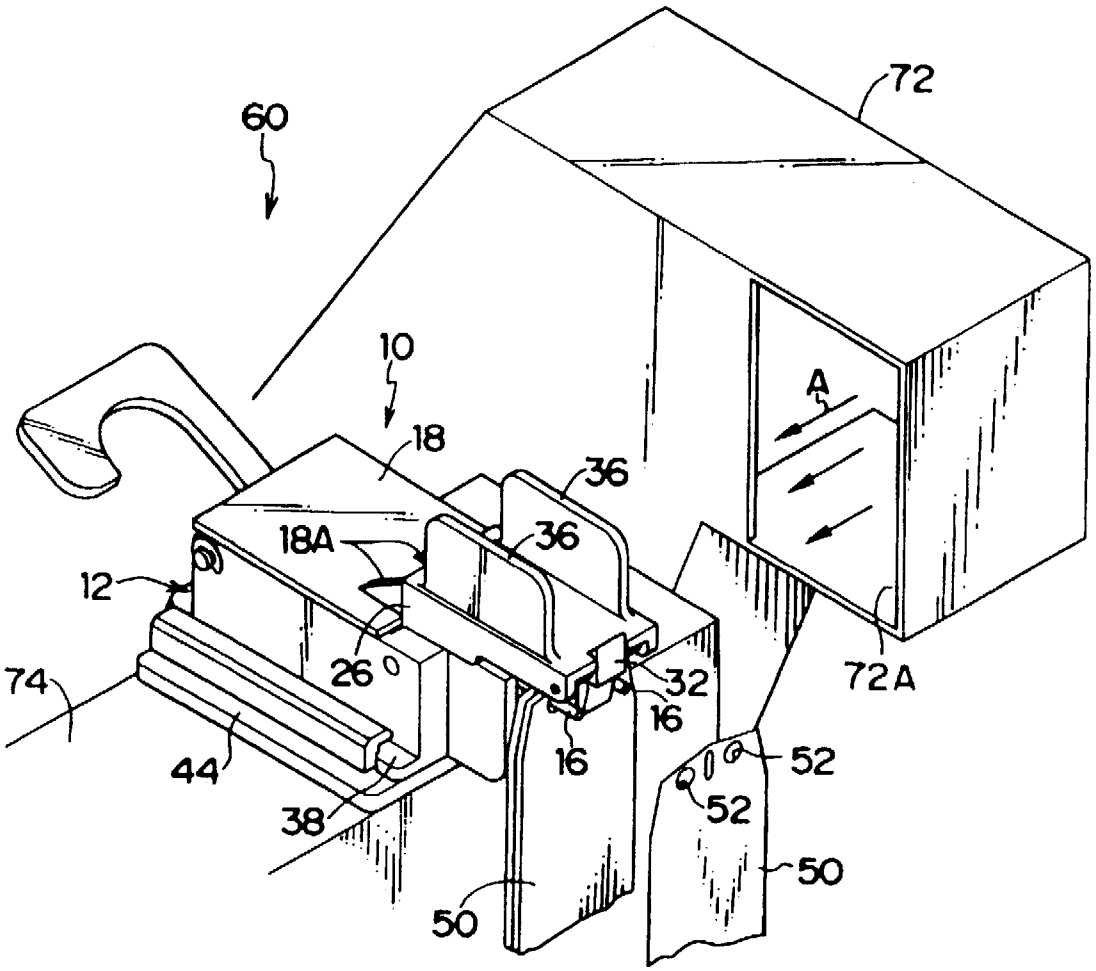
FIG. 7 is a perspective view which shows a state in which the film holder is mounted to the processing apparatus main body relating to the embodiment of the present invention.

As illustrated in FIGS. 5 and 7, a supporting stand 74 is provided at the position adjacent to the duct 72, and the mounting stand 44 is attached to the top of the supporting stand 74 by a pressure sensitive adhesive double coated tape or the like. As the film holder 10 is supported by the mounting stand 44, the film holder 10 is mounted to the processing apparatus main body 60 and is positioned with respect to the nozzle opening 72A.

As described above, the re-drying section is formed by the duct 72 and the supporting stand 74, and further, the development processing apparatus which is a film developing apparatus is formed by the film holder 10, and the processing apparatus main body 60 having the duct 72 and the supporting stand 74 or the like.

Next, the procedure and operation of the present embodiment will be explained.

Firstly, the negative film 50 is developed in the processing section 62 within the processing apparatus main body 60, and then the negative film 50 is dried by the dry hot air from the drying machine 66 within the drying section 64. Thereafter, the negative film 50 is conveyed to the discharge section 68, and is stocked in a state in which the leader L for conveyance is connected to the negative film 50.

The film holder 10 is in a state shown by the slid line in FIG. 1, i.e., the state in which the bracket 28 is protruded outwardly and the fixed lid 18 covers the opening 12A. Further, the film holder 10 in this state is attached to the mounting stand 44 attached to the supporting stand 74. An operator strips the adhesive tape from the negative film 50, which is conveyed out of the processing apparatus main body 60 and stocked in the discharge section 68. As illustrated in FIG. 7, the negative film 50 is moved so that the engaging pins 16 of the film holder 10 are inserted through the spool set holes 52 of the negative film 50. Consequently, the negative film 50 is engaged with the film holder 10.

Further, the negative films 50 are successively engaged with the film holder 10 in this way. As illustrated in FIG. 7, a large number of negative films 50 (e.g., the maximum number of 20 in the present embodiment) can be stacked.

Next, by the duct 72 which collects and blows the dry hot air, the dry hot air from the drying machine 66 is blown from the processing apparatus main body 60 to the distal end portions of the negative films 50 engaged with the film holder 10. Accordingly, the dry hot air is recycled and the distal end portions of the negative films 50 engaged with the film holder 10 are dried again.

At this time, as illustrated in FIG. 7, in a state in which the film holder 10 is attached to the mounting stand 44, the position of the nozzle opening 72A of the duct 72 which blows the dry hot air and the position of the film holder 10 are set so that the dry hot air flows parallel to the surfaces of the distal end portions of the negative films 50 held at the film holder 10.

Therefore, because the negative film 50 is dried in a state in which the leader L for conveyance is not connected thereto and is dried without using a clip which has a structure of nipping the negative film 50, the entire negative film 50, which includes the portion of the negative film 50 to which the leader L for conveyance has been connected, is fully dried.

Namely, the negative film 50 is engaged with the film holder 10 in the form of simply engaging the distal end portion of the negative film 50 with the engaging pin 16. Accordingly, even if a large number of negative films 50 are engaged, the hot dry air can be blown parallel to the surfaces of the distal end portions of the negative films 50 to which the leaders L for conveyance are connected. As a result, the portions of the negative films 50 to which the leaders L for conveyance are connected are sufficiently dried.

In this way, since re-drying is effected on the portions of the negative films 50 to which the leaders L for conveyance have been connected and in which drying tends to be insufficient, the portions of the negative films 50 to which the leaders L for conveyance have been connected by the adhesive tape can be completely dried and inconvenience at the subsequent processing due to insufficient drying of the negative films 50 can be prevented.

Next, a description will be given of a case in which the negative film 50 held at the film holder 10 is removed form the film holder 10. Firstly, the ribs 18A of the fixed lid 18 are held by an operator and the fixed lid 18 is rotated in the clockwise direction in FIG. 2. Due to this rotation, the state of preventing the rotation of the bracket 28 is released and the bracket 28 is rotated in the clockwise direction in FIG. 2 by the operator. As a result, since the withdrawal preventing pawl 32 is withdrawn from the portion between the engaging pins 16, the negative film 50 can be withdrawn from the engaging pins 16.

Moreover, at the time of holding the negative film 50, the above-described bracket 28 is pressed by the fixed lid 18 so as to prevent movement of the bracket 28 and falling of the negative film 50. Thus, in a state in which the negative film 50 is held at the film holder 10, the film holder 10 can be suspended by a hanger or the like.

In the present embodiment, the engaging pins are inserted through the spool set holes of the negative film. However, the engaging pins may be inserted through, e.g., perforation holes which are conventionally formed at the negative film.

In the present embodiment, an explanation is given of a case in which the negative film is used. However, other types of photographic films may be used in the present invention. Further, in the present embodiment, the distal end portion of the engaging pin is in the form of being cut in the direction perpendicular to the axial direction of the engaging pin. However, in order to ease installation of the negative film, the distal end portion of the engaging pin may be formed in the shape of hemisphere.

What is claimed is:

1. A development processing apparatus in which a photosensitive material is processed in processing solutions, and thereafter, said photosensitive material which has been processed in the processing solutions is subjected to drying processing by a dry air from a drying machine built in said development processing apparatus, comprising:

a re-drying section which delivers the dry air from said drying machine to the outer side of said development processing apparatus; and photosensitive material holding means in which, in order to dry again said photosensitive material which has been subjected to drying processing by the dry air from said re-drying section, said photosensitive material which has been subjected to drying processing is held such that the surface of said photosensitive material which has been subjected to drying processing is substantially parallel to the direction of the dry air delivered from said re-drying section.

2. A development processing apparatus according to claim 1, wherein said photosensitive material is a photographic film, and the positions of said re-drying section and said photosensitive material holding means are set so that the dry air from said re-drying section is delivered to the portion of said photographic film which includes at least a surface connected to a leader by a connecting tape for effecting said processing and said drying processing.

3. A development processing apparatus according to claim 1, wherein holes are formed at said photosensitive material, and said photosensitive material holding means includes a holder and a holder mounting portion, and said holder includes pins which are inserted through said holes by moving said photosensitive material so as to hold said photosensitive material, and said holder mounting portion removably supports said holder.

4. A development processing apparatus according to claim 2, wherein holes are formed at said photographic film, and said photosensitive material holding means includes a holder and a holder mounting portion, and said holder includes pins which are inserted through said holes by moving said photographic film so as to hold said photographic film, and said holder mounting portion removably supports said holder.

5. A development processing apparatus according to claim 3, wherein said holder includes a withdrawal preventing member which prevents withdrawal of said photosensitive material held by said pins from said pins.

6. A development processing apparatus according to claim 5, wherein said withdrawal preventing member is rotatable between a preventing position which prevents withdrawal of said photosensitive material held by said pins from said pins and an allowing position which allows movement of said photosensitive material and insertion of said pins through said holes.

7. A development processing apparatus according to claim 6, wherein said holder includes a spring which always urges said withdrawal preventing member from the direction of said allowing position to the direction of said preventing position.

8. A development processing apparatus according to claim 7, wherein said holder includes a first rotatable member, and said first rotatable member is rotatable between a first position which supports said withdrawal preventing member and at which said withdrawal preventing member is positioned at said preventing position and a second position at which said photosensitive material held by said pins is removable from said pins.

9. A development processing apparatus according to claim 8, wherein said holder includes a second rotatable member, and said second rotatable member is rotatable between a third position which prevents, when said first rotatable member is positioned at said first position, rotation of said first rotatable member from said first position to said second position and a fourth position which allows movement of said first rotatable member from said first position to said second position.

10. A development processing apparatus according to claim 3, wherein said holder includes a hook portion for suspending said holder itself.

* * * * *